US005746232A

United States Patent [19]

Martin et al.

[11] Patent Number: 5,746,232

[45] Date of Patent: May 5, 1998

[54] HAIRPIECE WITH REINFORCED MESH BASE

[75] Inventors: Randy Martin; Les Martin, both of Palm Beach, Fla.

[73] Assignee: First Lady Coiffures, Ltd., Canada

[21] Appl. No.: 831,727

[22] Filed: Apr. 1, 1997

[51] Int. Cl.[6] ..... A41G 5/00

[52] U.S. Cl. ..... 132/54

[58] Field of Search ..... 132/201, 53, 54, 132/55, 56

[56] References Cited

U.S. PATENT DOCUMENTS

| | | | |
|---|---|---|---|
| 3,447,541 | 6/1969 | Golden | 132/201 |
| 3,561,457 | 2/1971 | Duesel | 132/53 |
| 3,678,942 | 7/1972 | Abbott et al. | 132/201 |
| 4,509,539 | 4/1985 | Alfieri | 132/53 |
| 4,606,359 | 8/1986 | Palumbo et al. | 132/201 |

FOREIGN PATENT DOCUMENTS

| | | | |
|---|---|---|---|
| 3542123 | 6/1987 | Germany | 132/53 |

*Primary Examiner*—Todd E. Manahan
*Assistant Examiner*—E. Robert
*Attorney, Agent, or Firm*—McHale & Slavin

[57] ABSTRACT

A hairpiece to mask baldness comprises a lace-mesh substrate formed from a network of transversely-oriented fibers. A series of stabilizing rings are woven into the substrate. The hairpiece also includes a plurality of hairs extending from one side of the substrate. The hairpiece is sized and shaped to cover a selected portion of an individual's head. The hairpiece is removably attached through use of liquid adhesive.

5 Claims, 1 Drawing Sheet

HAIRPIECE WITH REINFORCED MESH BASE

FIELD OF THE INVENTION

This invention relates to hair replacement devices in general, and more particularly to a hairpiece having a reinforced, mesh base.

BACKGROUND OF THE INVENTION

Hair loss is a problem which affects many people. While some people affected by hair loss simply accept the resulting change in appearance, others do not and choose to retain a full head of hair. Over the years, devices have been created to help those individuals with thinning hair who wished to maintain the appearance of a full head of hair.

One early solution involved the use of full-head wigs to simply mask an individual's balding head. While the use of a wig would cover regions of lost or thinning hair, they were not the answer for everyone. Wigs which cover an individual's entire head not only masked area of lost or thinning hair, they also cover hair-populated areas. In essence, these full-head devices provided too much "coverage" for some individuals. Those individuals who wanted only partial coverage needed an alternate option.

In an attempt to help individuals with localized, as opposed to total, hair loss, partial-head-covering hairpieces were created. These hairpieces had the advantage of exposing an individual's existing hair, while covering balding areas. However, because these early hairpieces were essentially partial wigs with relatively-thick bases, they created new problems. The thick bases were not often sufficiently concealed by an individual's existing hair. As a result, use of the device was apparent to the public. Since hair replacement devices were worn specifically to improve the appearance of their wearers, "non-discrete" hairpieces were unacceptable solutions for many individuals.

To improve the appearance of partial-head-covering devices, designers began to make thin-based hairpieces. These typically incorporated a semi-rigid base that had been impregnated with hair. While these hairpieces were thinner, their rigid nature created an unnatural front hairline for those who wore them. As a result, the mounting structure was again visible to even the casual observers. Additionally, these did not promote airflow over a wearer's head. In turn, a wearer's scalp could not "breathe." Built-up heat and moisture made these hairpieces uncomfortable. Still yet a new design was needed.

Lace-front hairpieces were created to eliminate the appearance troubles caused by rigid-based hairpieces. Lace-front hairpieces were, essentially, rigid-based which had modified front pieces. These front pieces were made from a woven mesh onto which hairs had been attached. These hairpieces did, in some instances, improve the front hairline of wearers. Unfortunately, these hairpieces did not sufficiently address the breatheability problems present in the original rigid-base designs.

To improve breatheability and comfort, hair replacement hairpieces were created with bases made totally from mesh. While these hairpieces did improve breatheability, they, too, had problems. Chiefly, these all-mesh bases lacked sufficient structural integrity to be removed and re-applied on a repeated basis. They tended to become stretched out of shape with repeated uses. And to many individuals, wearing a hairpiece that does not fit correctly, is worse wearing than no hairpiece. Because many individuals chose to wear and remove their hairpiece daily, fragile, ill-fitting hairpieces were a not suitable solution.

Accordingly, what is needed is a hair replacement hairpieces which is breathable, blends inconspicuously with a user's existing hair, and has the structural integrity needed to withstand multiple applications and removals. Additionally, the hairpiece needs to have sufficient shape retention properties, so as to facilitate such multiple applications and removals.

SUMMARY OF THE INVENTION

This invention is a hairpiece having a base which is secured directly to an individual's scalp. The hairpiece employs a lace mesh substrate into which a desired number of hairs is knotted. The lace mesh is reinforced by a set of substantially-concentric stabilizing rings. The stabilizing rings allow the mesh to maintain a desired, customized shape. As a result, the stabilizing rings extend the useable life of the hairpieces, allowing it to be removed and reapplied as needed, with no degradation in fit quality. During use, the entire lace mesh substrate is coated with a supported liquid adhesive, and the adhesive acts to bond the entire scalp-facing surface of the hairpiece to a selected portion of the individual's head.

Accordingly, it is an object of the present invention to provide a hairpiece with a reinforced lace mesh base which may be removed and applied as needed, without loss in fit quality.

Another object of the present invention is to provide a hairpiece with a reinforced lace mesh base which allows an individual's scalp to "breathe."

Still another object of the present invention is to provide a hairpiece with a reinforced lace mesh base which may be repeatedly removed and correctly applied by an individual without undue effort.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Although the invention is described in terms of a specific embodiment, it will be readily apparent to those skilled in this art that various modifications, rearrangements and substitutions can be made without departing from the spirit of the invention. The scope of the invention is defined by the claims appended hereto.

Figure 1:
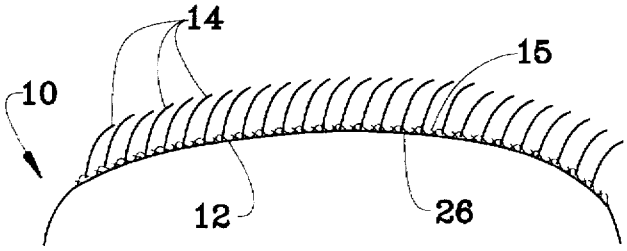
FIG. 1 is a side sectional view of a hairpiece of the present invention.
Figure 5:
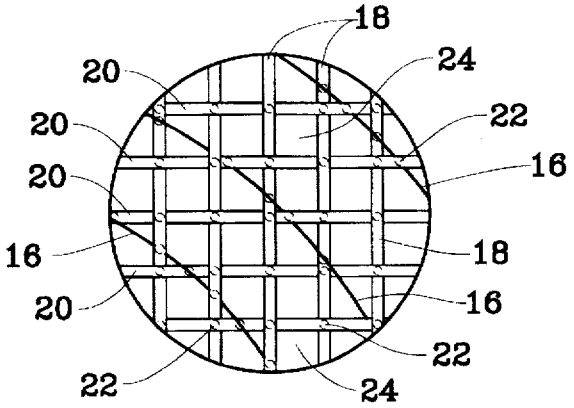
FIG. 5 is an enlarged view of the section bounded by circle 5 in FIG. 4 of the substrate of the present invention.

Now referring to FIGS. 1 and 5, a hairpiece 10 according to the present invention is shown. The hairpiece 10 includes a one-piece, lace-mesh substrate 12 that has been fashioned into a domed shell. A plurality of hairs 14 extends from an outer surface 15 of the substrate 12. A series of stabilizing rings 16 is woven into the substrate 12.

The substrate 12, itself, employs two transversely-oriented sets of fibers 18, 20. The fibers in the first set of fibers 18 are substantially parallel to each other and are evenly spaced apart. The fibers in the second set of fibers 20 are also substantially parallel to each other and are evenly spaced apart. The two sets of fibers 18,20 are oriented to overlap, forming a grid-like, lattice pattern.

The two sets of fibers 18,20 are joined at points of overlap 22 by a process of sonic welding. Once welded together, the two sets of fibers 18,20 form a multitude of four-sided, bounded regions 24. Because the two sets of fibers are welded together, the perimeter of each bounded region is fixed. However, because the fibers 18,20 are flexible, the amount of area within each bounded region 24 is not fixed. Each set of fibers 18,20 is made from nylon monofilament. Each fiber should have a diameter in the range of approximately two mils to approximately eleven mils.

The hairpiece 10 also includes a series of stabilizing rings 16 that are woven into the substrate 12. The stabilizing rings 16 are flexible, formed from nylon monofilament and arranged in a substantially-concentric fashion within the substrate 12. The rings 16 are sonically welded to fibers of the first and second sets of fibers 18,20, at points of overlap 22. The rings have a diameter which is approximately two-thirds the diameter of the first and second sets of fibers 18,20.

Figure 2:
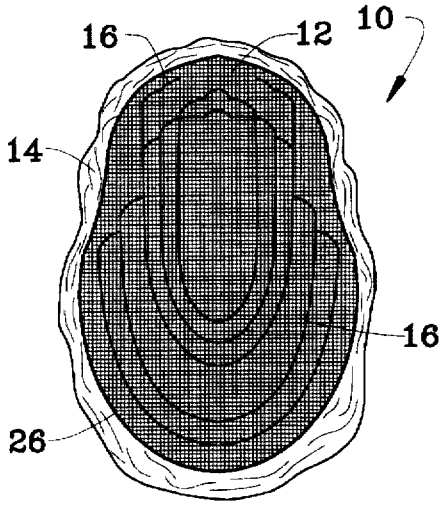
FIG. 2 is a bottom view of an embodiment of the present invention suitable for individuals with low-density hair growth.
Figure 3:
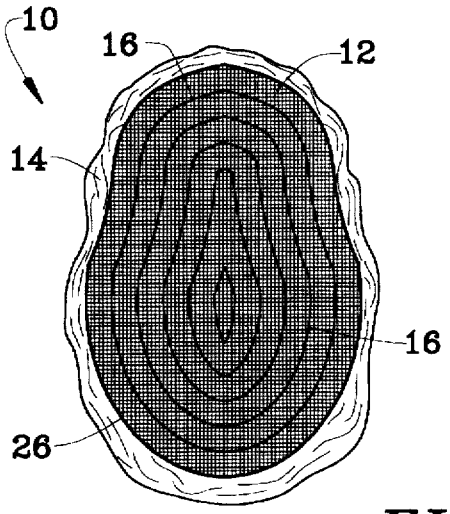
FIG. 3 is a bottom view of an embodiment of the present invention suitable for individuals with medium-density hair growth.
Figure 4:
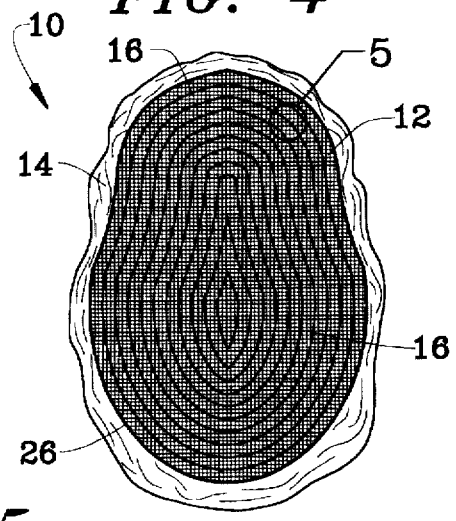
FIG. 4 is a bottom view of an embodiment of the present invention suitable for individuals with high-density hair growth.

Hairs 14 are attached to the substrate 12 and emerge from an outer surface 15 of the substrate 12. The hairs 14 are knotted, one hair at a time, onto the substrate at various points of overlap 22. Since the hairpiece 10 is designed to blend with the existing hair on an individual's head, the density of the hairs 14 included with the hairpiece 10 should roughly match the density of the hair of individual who will wear the hairpiece 10. To provide sufficient points of overlap 22 for attachment of an appropriate amount of hair 14, the number stabilizing rings 16 may be adjusted. Three examples of stabilizing ring 16 placement are shown in FIGS. 2, 3, and 4. FIG. 2 shows a pattern of stabilizing rings 16 which is appropriate for an individual with low-density hair growth. FIG. 3 shows a pattern of stabilizing rings 16 which is appropriate for an individual with medium-density hair growth. FIG. 4 shows a pattern of stabilizing rings 16 which is appropriate for an individual with high-density hair growth. The stabilizing rings 16 on each hairpiece 10 are substantially concentric.

The stabilizing rings 16 add structural integrity to the hairpiece 10. The nylon monofilament used in the present invention does not stretch noticeably under the forces typically applied by individuals during daily application and removal of the present hairpiece 10. That is, the tensile strengths of the first set of fibers 18, the second set of fibers 20, and the stabilizing rings 16 are higher than the forces applied during normal use of the hairpiece 10. However, the hairpiece 12 will easily deform under forces of typical magnitude which are applied in a direction that is not coaxial with the nylon monofilament. Since the stabilizing rings 16 are not co-axial with either the first or second set 18,20 of fibers, the presence of the rings 16 substantially increases the likelihood that forces applied to the substrate 12 will be directed along a nylon filament. This increased likelihood results in a concomitant increase in structural rigidity throughout the hairpiece 10.

In keeping with the objects of the present invention, the stabilizing rings 16 advantageously continue to reinforce the substrate 12 even after the hairpiece 10 has been customized to follow the contours of an individual's head. The stabilizing rings 16 have a tensile strength which is lower than the tensile strength of the first and second set 18,20 of fibers. During initial fitting and sizing of the hairpiece 10, the hairpiece is stretched tight against an individual's head. This stretching process applies force to the substrate. In some cases, the stretching forces are larger than the tensile limit of the stabilizing rings 16. As a result, the stabilizing rings 16 undergo controlled breakage. This desired breakage allows for expansion of some bounded regions 24, as needed to accommodate the shape of the individual's head. The forces applied during the initial fitting process are not sufficient to break fibers of the first or second set 18,20 of fibers. After the stretching and controlled breaking of the initial fitting, the hairpiece 10 fits the individual's head like a bathing cap.

In use, the hairpiece 10 is attached to the individual's head by application of a supported liquid adhesive to the scalp-facing surface 26 of the hairpieces. The hairpieces is removed by application of a solvent which breaks the bond between the user's head and the hairpieces. The hairpiece may be applied and removed on a daily basis or as needed by an individual.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A hairpiece comprising:

a one-piece mesh substrate sized to fit the head of an individual, said substrate including a first set of fibers and a second set of fibers;

a plurality of selectively-deformable stabilizing rings disposed within said substrate, said stabilizing rings including a third set of substantially-concentric, monofilament fibers sonically welded to said mesh substrate, said set of fibers having a tensile strength which is lower than a tensile strength of said first and second set of fibers; and a plurality of hairs attached to said substrate, whereby said stabilizing rings provide structural rigidity to said mesh substrate and maintain said substrate in a preferred orientation through several removals and applications of said hairpiece, thereby increasing the useable life of said hairpiece.

2. The hairpiece of claim 1, further including a securing means for temporarily securing said substrate to the scalp of an individual.

3. The hairpiece of claim 2, wherein said securing means is a supported liquid adhesive applied to a scalp-facing surface of said substrate.

4. The hairpiece of claim 1, wherein said mesh substrate is defined by a first set of substantially-parallel, spaced-apart fibers sonically welded to a second set of spaced-apart fibers, said first of spaced-apart fibers aligned generally parallel to a first axis, said second sets of spaced apart fibers being aligned generally parallel to a second axis, said first axis being non-parallel to said second axis.

5. A hair replacement hairpiece comprising:

a one-piece mesh substrate, said mesh substrate being formed from a first set of parallel spaced-apart fibers of first diameter and first tensile strength, and a second set of parallel spaced-apart fibers of said first diameter and first tensile strength, said second set of fibers sonically welded into an orientation which is substantially-perpendicular to said first set of fibers;

a plurality of stabilizing rings sonically welded to said mesh substrate, said plurality of stabilizing rings being fibers of a second diameter and second tensile strength, said second tensile strength being lower than said first tensile strength;

a plurality of hairs permanently attached to said mesh substrate; and securing means for temporarily securing said hairpiece to an individual's scalp, whereby said reinforcing rings provide controlled deformation of said mesh substrate.

* * * * *